US005123048A

United States Patent [19]

Miyamae et al.

[11] Patent Number: 5,123,048

[45] Date of Patent: Jun. 16, 1992

[54] SPEECH PROCESSING APPARATUS

[75] Inventors: Koichi Miyamae, Atusgi; Satoshi Omata, Machida, both of Japan

[73] Assignee: Canon Kabushiki Kaisha, Tokyo, Japan

[21] Appl. No.: 671,654

[22] Filed: Mar. 19, 1991

Related U.S. Application Data

[63] Continuation of Ser. No. 341,752, Apr. 21, 1989, abandoned.

[30] Foreign Application Priority Data

Apr. 23, 1988 [JP] Japan ..... 63-101173

[51] Int. Cl.[5] ..... G01L 5/00

[52] U.S. Cl. ..... 381/41; 381/42; 381/43

[58] Field of Search ..... 381/41-43; 364/513.5

[56] References Cited

U.S. PATENT DOCUMENTS 4,710,964 12/1987 Yamaguchi et al. .

FOREIGN PATENT DOCUMENTS 3446370 7/1986 Fed. Rep. of Germany .
2633656 2/1987 Fed. Rep. of Germany .

OTHER PUBLICATIONS

"Separation of Speech From Inter. Speech by Means of Harmonic Selections", T. W. Parson, *The Journal of the Acoustical Soc. of America, vol. 60, No. 4, Oct. 1976, pp. 911-918.*

"Selection of Acoustic Features for Speaker Identification", M. R. Sambur, *IEEE Transactions on Acoustics, Speech and Signal Processing*, vol. ASSP-23, No. 2, Apr. 1975, pp. 176-182.

"Recent Developments in Synchronization and Tracking With Synchronous Oscillators", T. Flamouropoulos, et al., *Proceedings of the 39th Annual Frequency Symposium-Phila., Pa., May 29-31, 1985, pp. 184-188, IEEE.*

"Entrainment of Two Coupled van der Pol Oscillators by an External Oscillation," by Oshuga et al., Biological Cybernetics, vol. 51, pp. 325-333 (1985).

"Pattern Recognition Based on Holonic Information Dynamics: Toward Synergetic Computers," by Shimizu et al. (1985).

"Principle of Holonic-Computer and Holovision," *Journal of the Institute of Electron., Info., and Communic.*, vol. 70, No. 9 (1987) by Shimizu et al.

"Holonic Model of Visual Motion Perception," *IEICE Technical Report*, Mar. 26, 1988, by Omata et al. and translation thereof.

*Primary Examiner*—Emanuel S. Kemeny

*Attorney, Agent, or Firm*—Fitzpatrick, Cella, Harper & Scinto

[57] ABSTRACT

The speech signal of one speaker in a plurality of signals of speakers can be isolated and recognized by using non-linear oscillators which lock on the fundamental and harmonic frequencies of the one speaker, whereby extraction of the one speaker's signals and speech recognition is done.

32 Claims, 9 Drawing Sheets

SPEECH PROCESSING APPARATUS

This application is a continuation of application Ser. No. 341,752, filed Apr. 21, 1989, now abandoned.

BACKGROUND OF THE INVENTION

1. Field of the Invention

The present invention relates to a speech processing apparatus, and more particularly to a speech processing apparatus which is capable of discriminating between significant information and unnecessary information in a large amount of speech information, extracting significant information, and processing it.

For example, the present invention relates to an apparatus which, when a large amount of speech data input from a plurality of talkers is handled, is capable of extracting as an object the speech information from a particular talker in the input information and processing it with respect to its vowels, consonants, accentuation and so on, and processing this speech.

2. Description of the Related Art

There are now demands in a wide range of industrial fields for information processing systems which function to extract significant data contained in a large volume of data such as speech input from a plurality of talkers therefrom and to process speech from a particular talker. Each of the conventional speech processing systems of the type which has been put into practical use comprises a speech input unit 300, a processing unit 305 and an output unit 304, as shown in FIG. 9. The speech input unit 300 contains, for example, a microphone or the like, and serves to convert sound waves traveling through air into electrical signals which are input as aural signals. The processing unit 305 comprises a feature-extracting section 301 for extracting the features of the aural signals that are input, a standard pattern-storing section 303 in which the characteristic patterns of standard speech have been previously stored and a recognition decision section 302 for recognizing the speech by collating the features extracted by the extracting section 301 with the standard patterns stored in the storing section 303.

Lately, digital computer systems have been often used as the processing unit 305 which employ a method in which various types of features are arithmetically extracted from all the input speech data and in which the intended speech is classified by searching for common features of the aural signals thereof from the various types of features extracted.

Speech processing is performed by collating the overall feature obtained by combining the above-described plurality of features (partial feature) extracted with the overall feature of the speech stored as the object of recognition in the storing section 303.

The above-described processing is basically performed for the entire local data of the aural signals input. In order to cope with the demand for high speed processing of complicated and massive speech data which is the first priority of industry, the processing of such complicated and massive speech data is generally conducted by devising an algorithm for the operational method, searching method and the like in each of the sections or by specializing, i.e., specifying, the information regions to be handled, on the assumption that the above-described arrangement and method are used. For example, the processing in the feature-extracting section 301 is based on digital filter processing, which is premised on the use of large hardware or signal processing software.

In regard to speech processing, in particular, conventional talker recognition processing for recognizing the speech of a designated talker by extracting it from the speech input from a plurality of talkers, high speed processing and a reduction in the size of a processing apparatus are contrary to each other.

SUMMARY OF THE INVENTION

It is an object of the present invention to provide a speech processing apparatus which is capable of extracting at high speed the speech of at least one particular talker from the aural signals containing the speech of a plurality of talkers.

In order to achieve this object, the speech processing apparatus of the present invention comprises an input means for inputting speech from a plurality of talkers and outputting aural signals; a plurality of speech collation processor elements for performing speech collation using the aural signals input, each of the processor elements comprising at least one non-linear oscillator circuit which is designed to bring about the entrainment effect at a first frequency peculiar to the speech of a particular talker; a detection means for detecting the entrained state of each of the processor elements; and an extraction means for extracting the aural signals of a particular talker from the aural signals input therein when it receives the output from the detection means on the basis of the frequency of oscillations of the output signal of the processor element entrained.

It is another object of the present invention to provide a speech processing apparatus which is capable of recognizing at high speed constituent talkers of the conversation from the aural signals containing the speech of a plurality of talkers.

In order to achieve this object, the speech processing apparatus of the present invention is a speech processing apparatus which serves to specify the constituent talkers of the conversion input from a plurality of specified talkers and which comprises an input means for inputting conversational speech and outputting aural signals; a plurality of speech collation processor elements for performing speech collation using the aural signals input therein, each of the processor elements comprising at least one non-linear oscillator circuit which is designed to bring about the entrainment effect at a first frequency peculiar to the speech of a particular talker; and a detection means for detecting the entrained state of each of the processor elements.

It is a further object of the present invention to provide a speech processing system which is capable of performing as a whole speech information processing of a particular talker at high speed by extracting at high speed the speech of at least one particular talker from the aural signals containing the speech of a plurality of talkers and performing information processing such as speech recognition processing and so forth, e.g., word recognition and so on, of the aural signals extracted.

In order to achieve this object, the speech processing system of the present invention comprises an input means for inputting the speech from a plurality of talkers and outputting aural signals; a plurality of speech collation processor elements for performing speech collation of the aural signals input therein, each of the processor elements comprising at least one non-linear oscillator circuit which is designed to bring about the entrainment effect at a first frequency peculiar to the speech of a particular talker; a detection means for detecting the entrained state of each of the processor elements; an extraction means for extracting the aural signals of a particular talker from the aural signals input therein on the basis of the frequency of oscillations of the output signal from each of the processor elements entrained when the means receives the output from the detection means; and an information processing means which is connected to the extraction means and which performs information processing such as word recognition and so on of the aural signals of a particular talker extracted by the extraction means.

In accordance with a preferred form of the present invention, each of the processor elements comprises two non linear oscillator circuits.

In accordance with a preferred form of the present invention, talker recognition is so set that entrainment of the corresponding processor element takes place at the average pitch frequency of a particular talker.

DESCRIPTION OF THE PREFERRED EMBODIMENTS

An embodiment of a speech processing system to which the present invention is applied is described below with reference to FIGS. 1 to 8.

Figure 1:
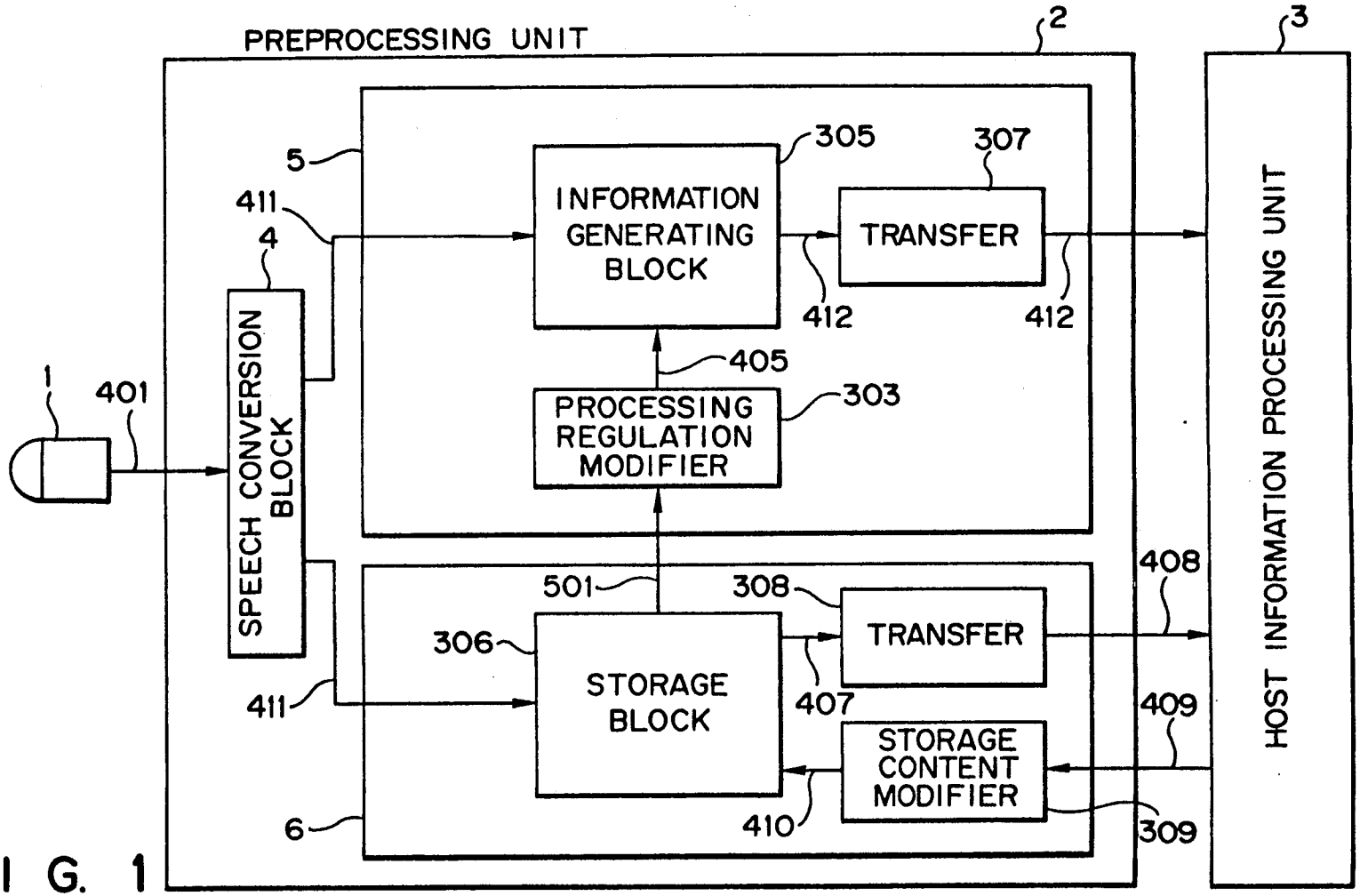
FIG. 1 is a block diagram of the basic configuration of a speech processing apparatus in accordance with the present invention.

FIG. 1 is a block diagram of a speech processing apparatus system related to this embodiment. In the drawing, reference numeral 1 denotes an input unit including a sensor for inputting information; and reference numeral 2, denotes a preprocessing unit for extracting a significant portion in the input information, i.e, the speech of a particular talker to be handled. The preprocessing unit 2 comprises a speech converting block 4, an information generating unit 5 and a storage unit 6. Reference numeral 3 denotes a host information processing unit comprising a digital computer system.

A description will now be provided of each of the constituent elements shown in FIG. 1. The input unit 1 comprises a microphone for inputting speech and outputting electrical signals 401. The host information processing unit 3 comprises the digital computer system.

The information generating unit 5 comprises an information generating block 305, a transferrer 307 for transmitting the information 412 generated by the information generating block 305 to the host information processing unit 3, and a processing modifier 303 for changing "the processing regulation" in the information generating block 305 when receiving a signal output from the storage unit 6.

The storage unit 6 comprises a storage block 306, a transferrer 308 for transmitting in a binary form "the memory recalled" by the storage unit 306 to the host information processing unit 3, and a storage modifier for changing "the storage contents" in the storage block 306 on the basis of instructions from the host information processing unit 3. The speech converting block 4 serves to convert the aural signals 401 input therein into signals 411 having a form suitable for processing in the information generating block 305.

The functions realized by the system of this embodiment are as follows:

(1): It is first recognized that the input aural signals 401 containing the speech of a plurality of talkers contain the aural signals of a particular talker. The recognition is conducted in the preprocessing unit 2 (specifically, in the storage block 306, the processing regulation modifier 303 and the storage content modifier 309), as described in detail below.

(2): Only a significant signal is extracted from the input aural signals 401 on the basis of the recognition of the item (1), i.e., the speech of the particular talker is extracted. This extraction processing is also conducted in the preprocessing unit 2 (specifically, in the information generating block 305) to generate extracted signals 412.

(3): The total information, which has been reduced by extracting the aural signals 412 only of the particular talker from the input aural signals 401 in the extraction of the item (2), is transmitted to the host information processing unit 3 through the transferrer 307. In the host information processing unit 3, processing of the speech of a particular talker, e.g., processing in which the words in the aural signals are recognized, or talker confirmation processing in which it is verified that the talker signals extracted by the preprocessing unit 2 are the aural signals of an intended talker, is performed by usual known computer processing methods.

(4): The talker whose speech is extracted can be specified by instructing the storage content modifier 309 from the host information processing unit 3.

In accordance with the knowledge obtained from recent techniques with respect to speech information processing, the recognition of a particular talker can be performed on the basis of differences in the physical characteristics of the sound-generating organs among talkers. The most typical physical characteristics of the sound-generating organs include the length of the vocal path, the frequency of the oscillations of the vocal cords and the waveform of the oscillations thereof. Such characteristics are physically observed as a frequency level of the formant, the band width, the average pitch frequency, the slope and curvature in terms the spectral outline and so forth.

In the system shown in FIG. 1, a talker recognition is performed by detecting the average pitch frequency peculiar to the relevant talker in the aural signals 401. This average pitch frequency is detected in such a manner that the stored pitch frequencies are recalled in the storage unit 6 of the preprocessing unit 2. Since any human speech can be expressed by superposing signals having frequencies that are integral multiples of the pitch frequencies, when a signal with a frequency of integral multiples of the average pitch frequency detected is extracted from the stored aural signals 401 by the information generating block 305, the signal extracted is an aural signal peculiar to the particular talker.

Non-linear oscillator circuit

The preprocessing unit 2 serves as a central unit of the system in this embodiment. Either of the information generating block 305 or the storage block 306 which serves as a central part comprises a plurality of non linear oscillator circuits or the like.

In accordance with the understanding of the inventors, the contents of information can be encoded into the phase or frequency of a non-linear oscillator, and the magnification of information can be represented by using the amplitude of the oscillation thereof. In addition, the phase, frequency and amplitude of oscillation can be changed by causing interference between a plurality of oscillators. Causing such interference corresponds to conventional information processing. The interaction between a plurality of non. linear oscillators which are connected to each other causes deviation from the individual intrinsic frequencies and thus mutual excitation, that is "entrainment". In other words, two types of information processing, i.e., the recall of memory performed in the storage block 306 and extraction of the aural signals of a particular talker which is performed in the information generating block 305, are carried out in the preprocessing unit 2. These two types of information processing in the preprocessing unit 2 are performed by using the entrainment taking place owing to the mutual interference between the nonlinear oscillator circuits.

The entrainment is a phenomenon which is similar to resonance and in which all the oscillator circuits make oscillations with the same frequency, amplitude and phase owing to the interference therebetween even if the intrinsic frequencies of the oscillator circuits are not equal to each other. Such entrainment taking place by the interference between the nonlinear oscillators which are coupled with each other is explained in detail in "Entrainment of Two Coupled van der Pol Oscillators by an External Oscillation" (Bio. Cybern. 51, 325-333 (1985)).

It is well known that such a nonlinear oscillator circuit is configured by assembling a van der Pol oscillator circuit using resistor, capacitor, induction coil and negative resistance elements such as a Esaki diode. This embodiment commonly utilizes as a nonlinear oscillator circuit such a van der Pol oscillator circuit as shown in FIG. 2.

Figure 2:
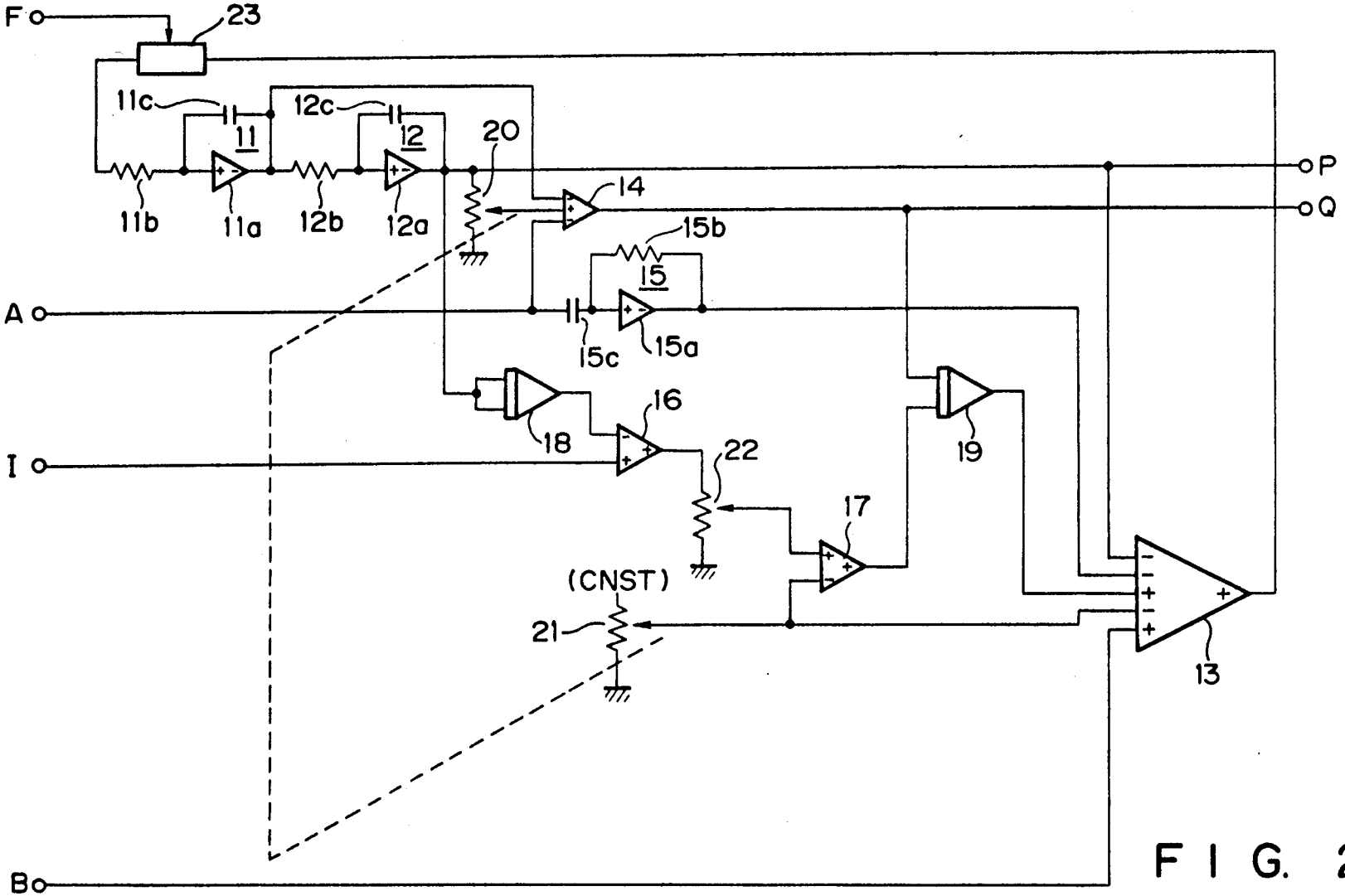
FIG. 2 is a drawing of van der Pol-type non-linear oscillator circuits forming each processor element.

In FIG. 2, reference numerals 11*a*, 12*a*, 13, 14, 15*a*, 16 and 17 respectively denote an operational amplifier in which the signs + and − respectively denote the polarities of output and input signals. The resistors 11*b*, 12*b* and the capacitors 11*c*, 12*c* which are shown in the drawing are applied to the operational amplifiers 11*a*, 12*a*, respectively, to form integrators 11, 12. A resistor 15*b* and a capacitor 15*c* are applied to the operational amplifier 15*a* to form a differentiator 15. The resistors shown in the drawing are respectively applied to the other operational amplifiers 13, 14, 16, 17 to form adders. The van der Pol circuit in this embodiment is also provided with multipliers 18, 19. In addition, voltages are respectively input to the operational amplifiers 13, 14, 17 serving as the adders through variable resistors 20 to 22, the variable resistors 20, 21 being interlocked with each other.

The oscillation of this van der Pol oscillator circuit is controlled through an input terminal I in such a manner that the amplitude of oscillation is increased by applying an appropriate positive voltage to the terminal I and it is decreased by applying a negative voltage thereto. A gain controller 23 can be controlled by using the signal input to an input terminal F so that the basic frequency of oscillation of the van der Pol oscillator circuit can be changed. In the oscillator circuit shown in FIG. 2, the basic oscillation thereof is generated by a feedback circuit comprising the operational amplifiers 11, 12, 13, and another part, for example, the multiplier 18, provides the oscillation with nonlinear oscillation characteristics.

As described above, the entrainment is achieved by utilizing interference coupling with another van der Pol oscillator circuit. When the van der Pol oscillator circuit shown in FIG. 2 is coupled with another van der Pol oscillator circuit having the same configuration, the signal input from the other van der Pol oscillator circuit is input in the form of an oscillation wave to each of the terminals A, B shown in FIG. 2, as well as the oscillation wave being output from each of the terminals P, Q shown in the drawing (refer to FIG. 3). When there is no input, the phases of the output P, Q are 90° deviated from each other and when interference input is applied from the other oscillator circuit, this phase difference between output P, Q is changed in correspondence with the relationship between the input and the oscillation wave thereof, as well as the frequency and amplitude being changed.

Figure 3:
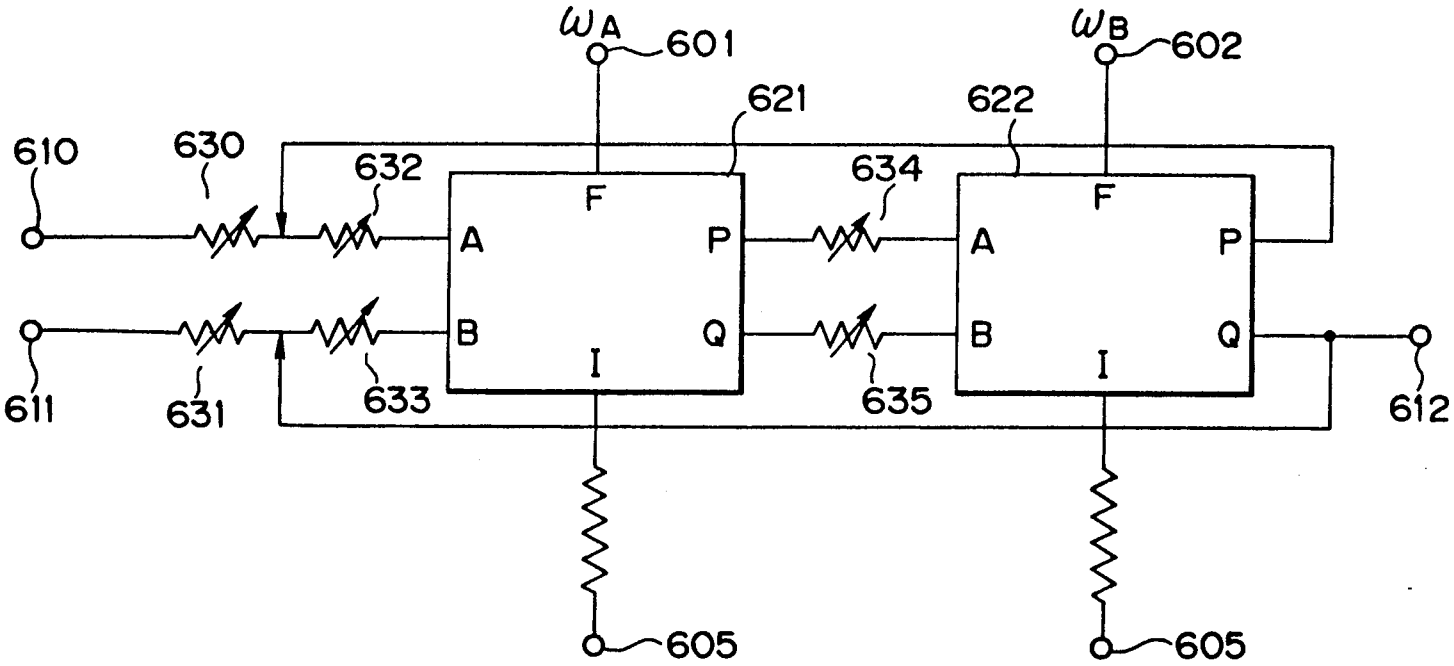
FIG. 3 is an explanatory view of the wiring in the case where each processor element comprises two van der Pol circuits.

This embodiment utilizes as a processor element forming each of the storage block 306 and the information generating block 305 an element comprising the two van der Pol nonlinear oscillator circuits (621, 622) shown in FIG. 2 which are connected to each other, as shown in FIG. 3. In FIG. 3, one of the processor elements has input terminals 610, 611, an output terminals 616 and terminals 601, 602 for respectively setting the natural frequencies of the nonlinear oscillator circuits 621, 622. The processor element also has six variable resistors 630 to 635.

A description will now be provided of the entrainment phenomenon of each processor element having the arrangement shown in FIG. 3. It is assumed that each of the two coupled nonlinear oscillation circuits 621, 622 are already in a certain entrained state which can be obtained by setting resistors 632, 633 and 634 at appropriate values thereof. In order to be able to change the element into another entrained state in response to the input signal to terminals 610, 611, the values of the resistors 630, 631 should be appropriately set. When the signal input to the terminals 610, 611 has a single oscillation component, the processor element is entrained in oscillation with the same frequency as that of the input signal from the oscillation in the state wherein the processor element is entrained if the component is within a range of frequencies in which entrainment newly takes place. This represents one form of the entrainment phenomenon. When an input signal has a plurality of oscillation components, the processor element has a tendency to be entrained in the oscillation with the frequency closest to the frequency of the component in the entrained state among the oscillation components.

Whether or not the processor element is activated is controlled by using a given signal input from the outside (the modifier 309 shown in FIG. 1) through terminals 605*a* and 605*b*. In other words, a negative voltage may be added to the terminal I from the above-described external circuit for the purpose of deactivating the processor element regardless of the signal input to the terminals 610, 611.

The signal input to the terminal F of the van der Pol circuit is used for determining the basic frequency of the van der Pol circuit, as described above. In FIG. 3, if the signal $\omega_A$ input to the terminal 601 of the van der Pol circuit 621 functions to set the frequency of the oscillator circuit 621 to $\omega_A$, the signal $\omega_B$ input to the terminal 602 of the van der Pol circuit 622 also functions to set the frequency $\omega_B$ of the oscillator circuit 622 to $\omega_B$. Consequently, the processor element functions as a band pass filter and has a central frequency expressed by the following equation (1):

$$\text{about } \frac{\omega_A + \omega_B}{2} \tag{1}$$

and a band width $\Delta$ expressed by the following equation (2) if $\omega_A > \omega_B$:

$$\Delta = (\omega_A - \omega_B) \tag{2}$$

That is, among the signals input to the processor element, only the component satisfying the above-described equations (1) and (2) is output from the processor element. Particularly, when the frequencies of the signals input to the terminals 610, 611 are $\omega_1$, $\omega_2$, $\omega_3$, if only $\omega_1$ is within the above-described band width $\Delta$, the frequency of the processor element is $\omega_1$ after being entrained.

Preprocessing unit

Since the preprocessing unit 2 serves as a central unit of the system of this embodiment, the structure and operation of this section are described in detail below with reference to FIG. 4.

Figure 4:
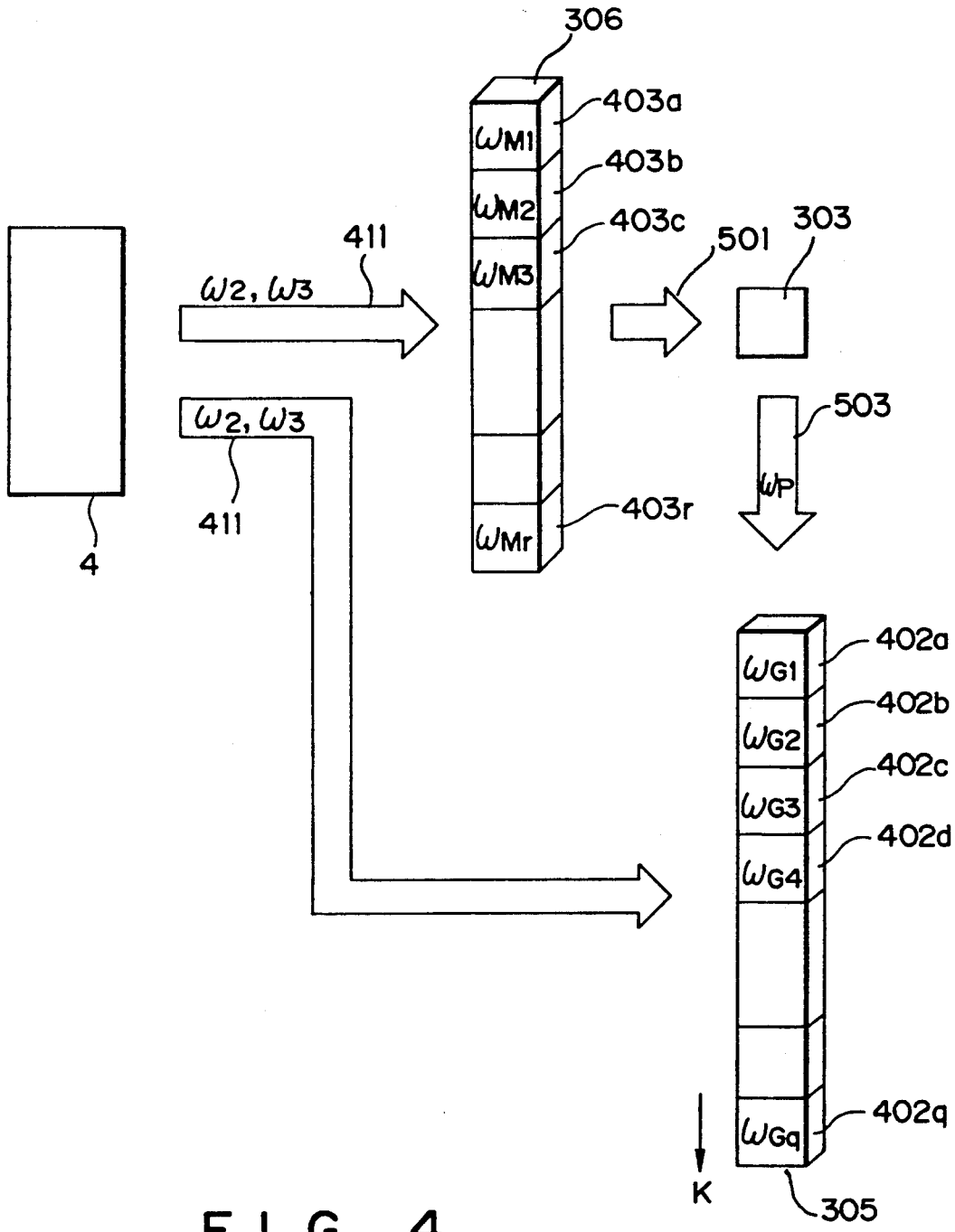
FIG. 4 is a detailed explanatory view of the configuration of a preprocessing unit.

In FIG. 4, the speech input from the microphone 1 is introduced as the electrical signals 401 into the speech converting block 4 which serves as a speech converter for the preprocessing unit 2. The aural signals 402 converted in the block 4 are sent to the storage block 306 and the information generating block 305. An processor element of either of the information generating block 305 or the storage block 306 comprises the van der Pol oscillator circuit. The speech converting block 4 functions to convert the aural signals 401 into signals having a form suitable for being input to each van der Pol oscillator circuit (for example, the voltage level is modified).

The storage block 306 has such processor elements as shown in FIG. 3 in a number which equals the number of the talkers to be recognized. The recognition of speech of r talkers requires r processor elements 403 in which center frequencies $\omega_{M1}$, $\omega_{M2}$ . . . $\omega_{Mr}$ and band widths $\Delta_{M1}$, $\Delta_{M2}$ . . . $\Delta_{Mr}$ must be respectively set. The central frequencies $\omega_{M1}$, $\omega_{M2}$ . . . $\omega_{Mr}$ are substantially the same as the average pitch frequencies of the r talkers. For example, in a processor element 403*a* for detecting a talker No. 1, a given signal is input to each of the two terminals F shown in FIG. 3 so that the central frequency $\omega_{M1}$ and the band width $\Delta_{M1}$ respectively satisfy the above-described equations (1) an (2). This setting will be described below with reference to FIG. 6.

The aural signals 402 from the speech converting block 4 are input to the terminals 610, 611 of each of the processor elements of the storage block 306.

On the other hand, the information generating block 305 also has a plurality of such processor elements 402 as shown in FIG. 3. In the example shown in FIG. 4, q processor elements 402 are provided in the unit 305. The number of processor elements required in the information generating block 305 must be determined depending upon the degree of resolution with which the speech of a particular talker is desired to be extracted. Each of the processor elements 402 of the information generating block 305 also functions as a band pass filter in the same way as the processor elements 403 of the storage block 306. If the processor elements 402 are numbered in turn from the above element and the numerals of the element are denoted by k, the transmission frequency $\omega_k$ at which the processor element k functions as a band pass filter is determined so as to have the relationship (3) described below to the basic pitch frequency $\omega_p$ of the talker recognized in the storage block 306.

$$\omega_k = k\,\omega_p \tag{3}$$

In other words, in the q processor elements 402*a* to 402*q*, their central frequencies $\omega_{G1}$, $\omega_{G2}$ . . . $\omega_{Gq}$ and the band widths $\Delta_{G1}$, $\Delta_{G2}$ . . . $\Delta_{Gq}$ are respectively set so as to satisfy the equations (1) and (2). This setting in the processor elements 402 is described in detail below with reference to FIG. 5.

Each of the storage block 306 and the information generating block 305 has the above-described arrangement.

As described above, the processor elements 402 of the information generating block 305 and the processor elements 403 of the storage block 306 are respectively band pass filters having central frequencies which are respectively set to $\omega_{M1}$, $\omega_{M2}$ . . . $\omega_{Mr}$ and $\omega_{G1}$, $\omega_{G2}$ ... $\omega_{Gq}$. However, each of these processor elements does not functions simply as a replacement for a conventional known band pass filter, but it efficiently utilizes the characteristics as a processor element comprising nonlinear oscillator circuits. The characteristics include the easiness of modifications of the central frequencies expressed by the equation (1) and the band widths expressed by the equation (2) as well as a high level of selectivity for frequency and responsiveness, as compared with conventional band pass filters.

In the storage block 306, collations of the aural signals 402 with the pitch frequencies previously stored for a plurality of talkers are simultaneously performed for each of the talkers to create an arrangement of the talkers contained in the conversation. That is, the arrangement of talkers contained in conversation can be determined by recognizing the talkers giving speech having the pitch frequencies contained in the conversation expressed by the aural signals 411. The storage of the pitch frequencies in the processor elements 403*a* to 403*r* of the storage block 306 is realized by interference oscillation of the processor elements with the basic frequency which is determined by the signals $\omega_A$, $\omega_B$ input to the terminal F, as described above with reference to FIG. 3. In other words, the pitch frequencies of the talkers are respectively stored in the forms of the basic frequencies of the processor elements. If the aural signals 411 contain the speech signals of talkers having pitch frequency components $\omega_2$, $\omega_3$ which are close to $\omega_{M2}$, $\omega_{M3}$ (i.e., $\omega_2=\omega_{M2}$ and $\omega_3=\omega_{M3}$), the processor elements 403*a*, 403*b* alone interfere with the input aural signals 411, are activated so as to be entrained and make oscillation with the frequencies $\omega_2$, $\omega_3$, respectively. That is, in the case of conversation of a plurality of talkers, only the processor elements having the frequencies which are set to values close to the average pitch frequencies of the talkers are activated, this activation corresponding to the recall of memory.

The results 501 recalled in the processor elements 403 of the storage block 306 are sent to the processing modifier 303. The processing modifier 303 has the function of detecting the frequencies of the output signals 501 from the processor elements 403, as well as the function of calculating the processing regulation used in the information generating block 305 from the oscillation detected. This processing regulation is defined by the equation (3).

In the information generating block 305, a significant portion, that is, the feature contributing to a particular talker, is extracted from the signals 411 input from the speech converting block 4 in accordance with the processing regulation supplied from the processing regulation modifier 303, and then output as a binary signal to the host information processing unit 3 through the transferrer 307. The binary signal is then subjected to speech processing in the unit 3 in accordance with the demand.

The configuration of talkers can also be recognized by virtue of the host information processing unit 3 based on the information sent from the storage block 306 to the host information processing unit 3 through the transferrer 308.

The information generating block 305 is also capable of adding talkers to be handled and setting parameter data thereof as well as removing talkers.

Extraction of Speech of Particular Talkers

A final object of the system of this embodiment is to recognize the speech of particular talkers (plural). As described above with respect to the storage block 306, only the processor elements 403 which correspond to the pitch frequencies of particular talkers are activated by the recall of memory in the storage block 306. The activated state is transferred to the information processing unit 3 through the transferrer 308. On the other hand, the processing regulation modifier 303 detects the frequencies of the output signals 501 from the storage block 306 and modifies the processing regulation in the processor elements 403*a* to 403*q* of the information generating block 305 in accordance with the equation (3).

Figure 5:
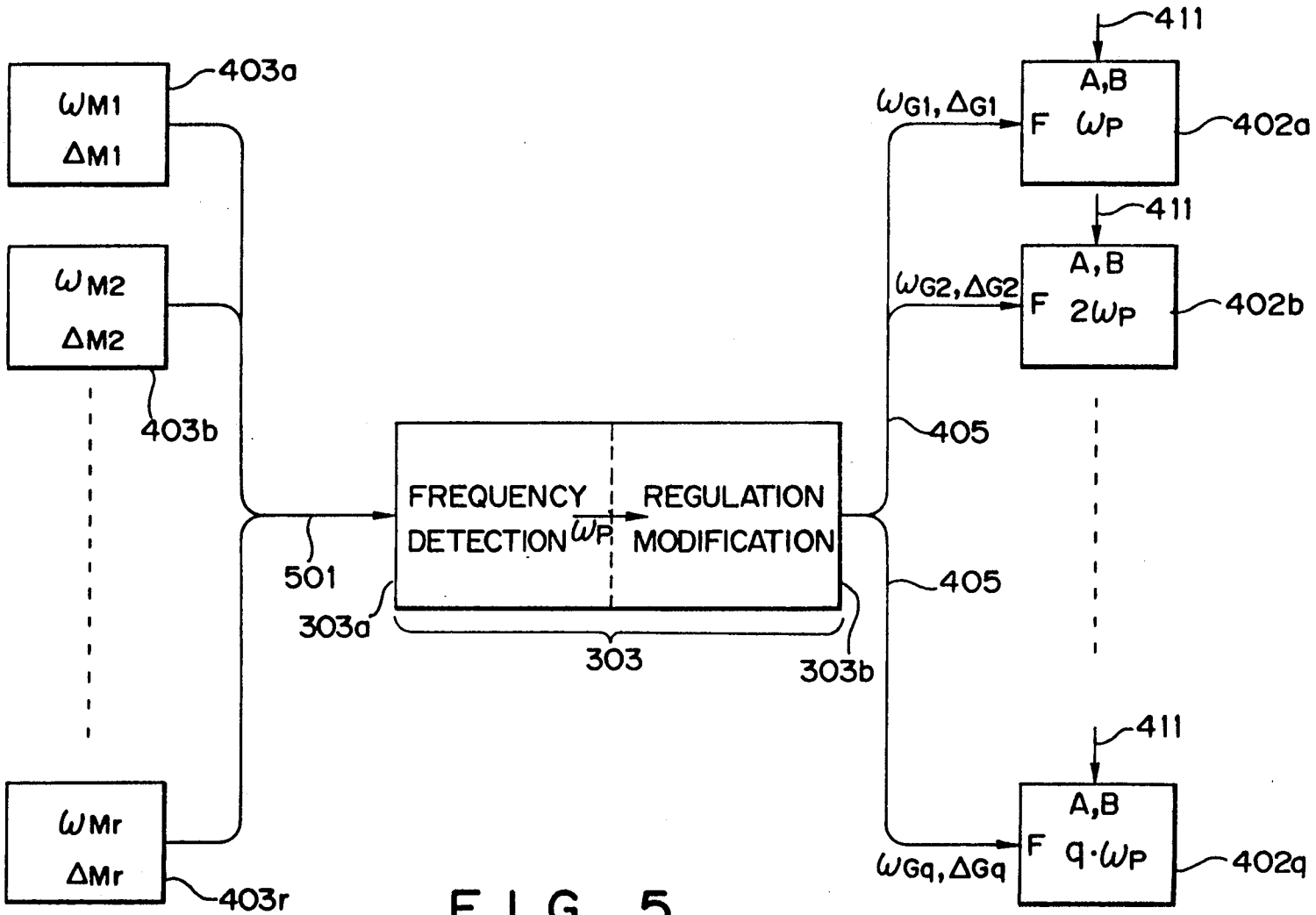
FIG. 5 is an explanatory view of the connection between a storage block, a regulation modifier and an information generating block.

FIG. 5 is a drawing provided for explaining the connection between the processor element 403, the processing regulation modifier 303 and the processor element 402 and for explaining in detail the connection therebetween shown in FIG. 3. The configuration and connection shown in FIGS. 3 and 5 are used for extracting the speech of a particular talker from the conversation of a plurality of talkers. The method of recognizing the speech of only one talker is described below using the relationship between the storage block 306 and the storage content modifier 309.

As shown in FIG. 5, the modifier 303 comprises a frequency detector 303*a* and a regulation modifier 303*b*. The recognition of the average pitch frequency $\omega_p$ of a particular talker in the aural signals 411 by the storage block 306 represents the activation of the processor element (of the storage block 306) having a frequency that is close to $\omega_p$. The output signal 501 from the storage block 306 therefore has a frequency $\omega_p$. The frequency $\omega_p$ is detected by the frequency detector 303*a* of the modifier 303 and then transmitted to the regulation modifier 303*b* thereof.

The regulation modifier 303*b* is connected to each of the processor elements 402, as shown in FIG. 5. For example, signal lines $\omega_{G1}$, $\Delta_{G1}$ are provided between the modifier 303 and the processor element 402*a* so as to be connected to the two terminals F (refer to FIG. 3) of the processor element 402*a*.

As shown in FIG. 5, each of the processor elements 402*a* to 402*q* are respectively so set as to function as band pass filters with center frequencies $\omega_p$, $2\omega_p$, $3\omega_p$, . . . , $q\omega_p$. In other words, when the pitch frequency $\omega_p$ of a particular talker is detected by the frequency detector 303*a*, the regulation modifier 303*b* outputs signals to the signal lines $\omega_{G1}$, $\Delta_{G1}$, $\omega_{G2}$, $\Delta_{G2}$, . . . $\omega_{Gk}$, $\Delta_{Gk}$ . . . $\omega_{Gq}$, $\Delta_{Gq}$ so that the processor elements 402*a* to 402*q* satisfy the following equation:

$$\omega_k = k\,\omega_p$$

Since the aural signals 411 are input to the terminals A, B (refer to FIG. 3) of each of the processor elements 402*a* to 402*q*, the processor elements respectively allow only the signals with set frequencies $\omega_p$, $2\omega_p$, $3\omega_p$, . . . $k\omega_p$ . . . $q\omega_p$ to pass therethrough. These signals passed are transmitted to the host information processing unit 3 through the transferrer 307.

Recognition of Particular Talker

Figure 6:
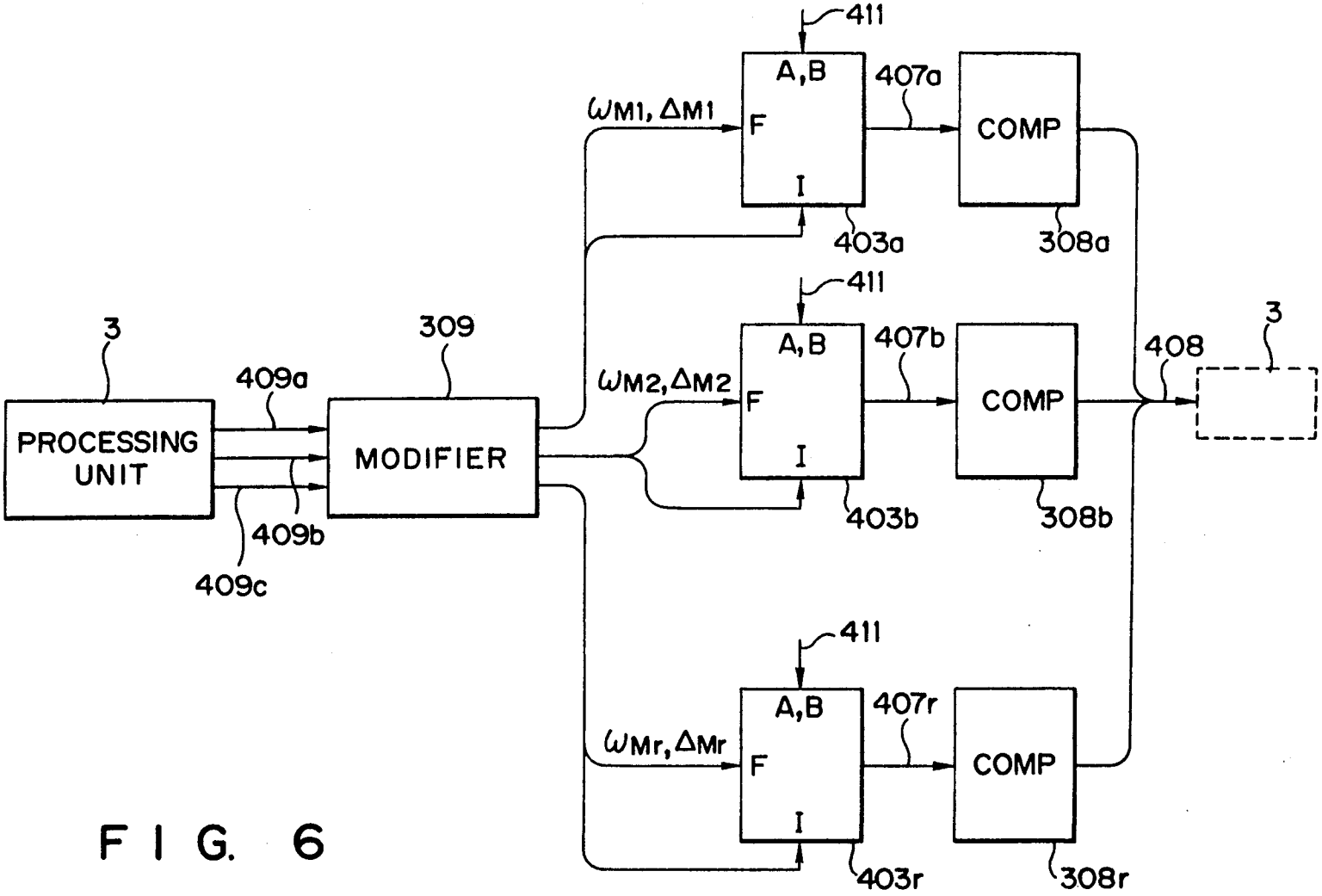
FIG. 6 is an explanatory view of the connection between a host information processing unit, a modifier, an information generating block and a storage block.

FIG. 6 is a drawing of connection between the storage modifier 309, transferrer 308 and the processor elements 403*a* to 403*p* which is so designed as to able to recognize the speech of a particular talker in the aural signals 411.

Three signal lines are provided between the modifier 309 and each of the processor elements. Of these three signal line, two signal lines are used for setting the central frequency $\omega_M$ and the band width $\Delta_M$ of each processor element and are connected to the two terminals F thereof. The other signal line is connected to the terminal I (FIG. 3) for the purpose of forcing each of the processor elements to be in a deactivated state. As described above, a negative voltage is applied to the terminal I each processor element in order to deactivate it.

Three types of information 409*a* to 409*c* are transferred from the host information processing unit 3 to the modifier 309, and the host information processing unit 3 is capable of setting any desired central frequency and band width of any processor element of the storage block, as well as inhibiting any activation of any desired processor element, by using these three types of information. The signal on the signal line 409*a* contains the number of a processor element in which a central frequency and band width are set or which is inhibited from being activated. The signal on the signal line 409*b* contains the data with respect to the central frequency and band width to be set, and the signal on the signal line 409*c* contains the data in the form of a binary form with respect to whether or not the relevant processor element is activated. The transferrer 308 comprises r comparators (308*a* to 308*r*). The comparator compares the output of the corresponding processor element with a predetermined threshold value and outputs one if the output of the corresponding element exceeds the threshold. The transferrer 308 transfers in a binary form the result of comparison to the processing unit 3.

The above-described configuration enables the host information processing unit 3 to activate or deactivate any one desired processor element of the storage block 306 or to set/modify the band width and the central frequency thereof.

When a particular one processor element determined by the modifier 309 is activated by the input aural signals 411, and when the pitch frequency $\omega_p$ thereof is detected by the modifier 303, the aural signal of the particular talker alone is extracted from the aural signals 411, as described in FIG. 5.

Host Unit

Figure 7:
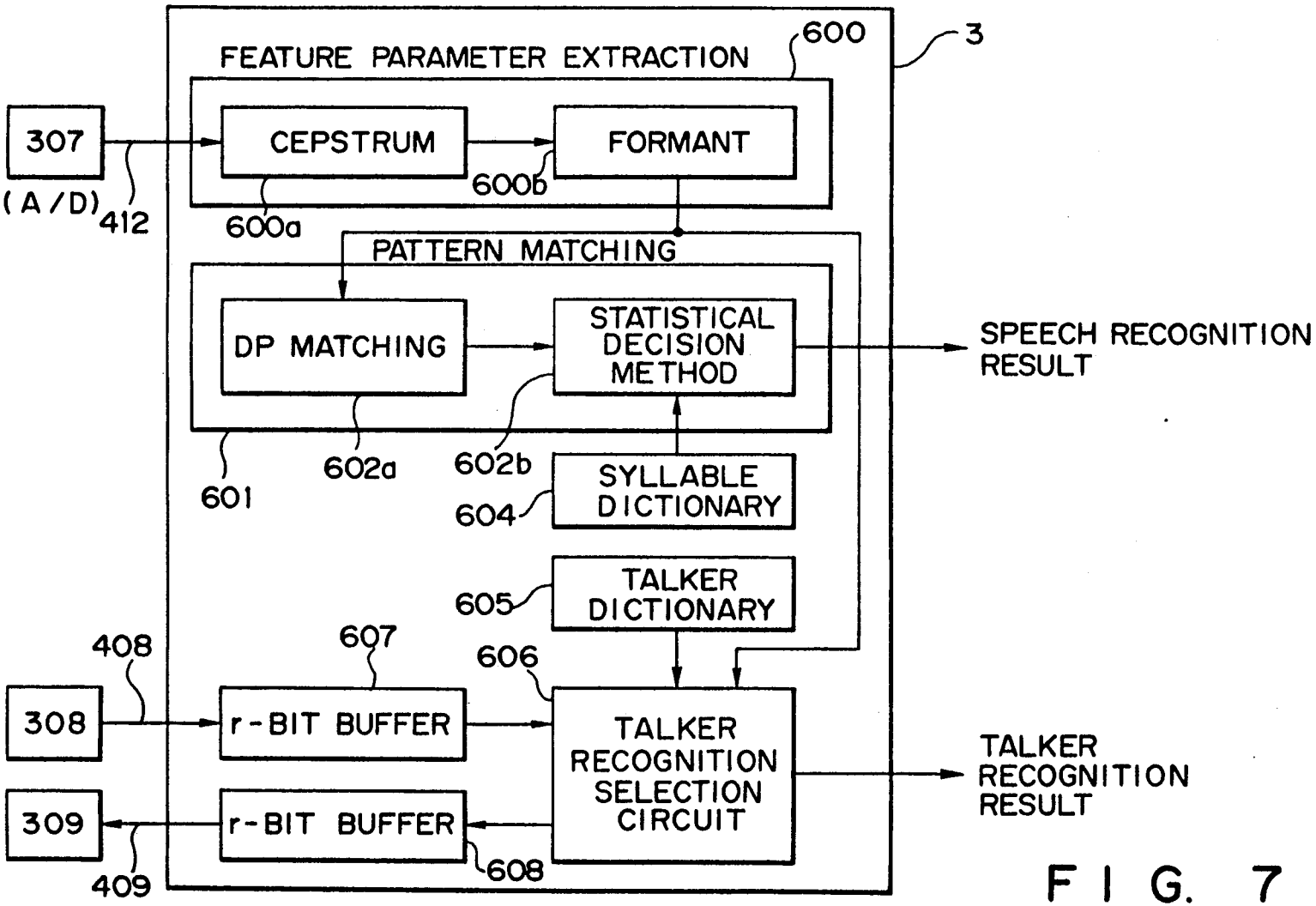
FIG. 7 is an explanatory view of the configuration of a host information processing unit.

FIG. 7 is a functional block diagram of the processing in the host information processing unit 3 in which speech recognition and talker recognition (talker collation) are mainly performed. One subject of the present invention lies in the processing of the speech signals used for two types of recognition in the preprocessing unit. Since these two types of recognition themselves are already known, they are briefly described below.

The aural signal 412 from the transferrer 307 of the preprocessing unit 2 is a signal containing only the speech of a particular talker. This signal is A/D converted in the transferrer 307 and then input to the processing unit 3. The signal 412 is subjected to cepstrum analysis in 600*a* in which spectrum estimation is made for the aural signal 412. In such spectrum estimation, the formants are extracted by 600*b*. The formant frequencies are frequencies at which concentration of energy appears, and it is said that such concentration appears at several particular frequencies which are determined by phonemes. Vowels are characterized by the formant frequencies. The formant frequencies extracted are sent to 601 where pattern matching is conducted. In this pattern matching, speech recognition is performed by DP matching (502*a*) which is performed for the syllables previously stored in a syllable dictionary and the formant frequencies and by statistical processing (602*b*) of the results obtained.

A description will now be provided of the talker recognition performed in the unit 3.

Although rough talker recognition is carried out in the storage block 306 of the preprocessing unit 2, the talker recognition conducted in the unit 3 is more positive recognition which is carried out using a talker dictionary 605 after the rough talker recognition has been carried out.

In the talker dictionary 605, are stored data with respect to the level of the formant frequency, the band width thereof, the average pitch frequency, the slope and curvature in terms of frequency of the spectral outline and so forth of each of talkers, all of which are previously stored, as well as the time length of words peculiar to each talker and the pattern change with time of the formant frequency thereof.

Application

Figure 8:
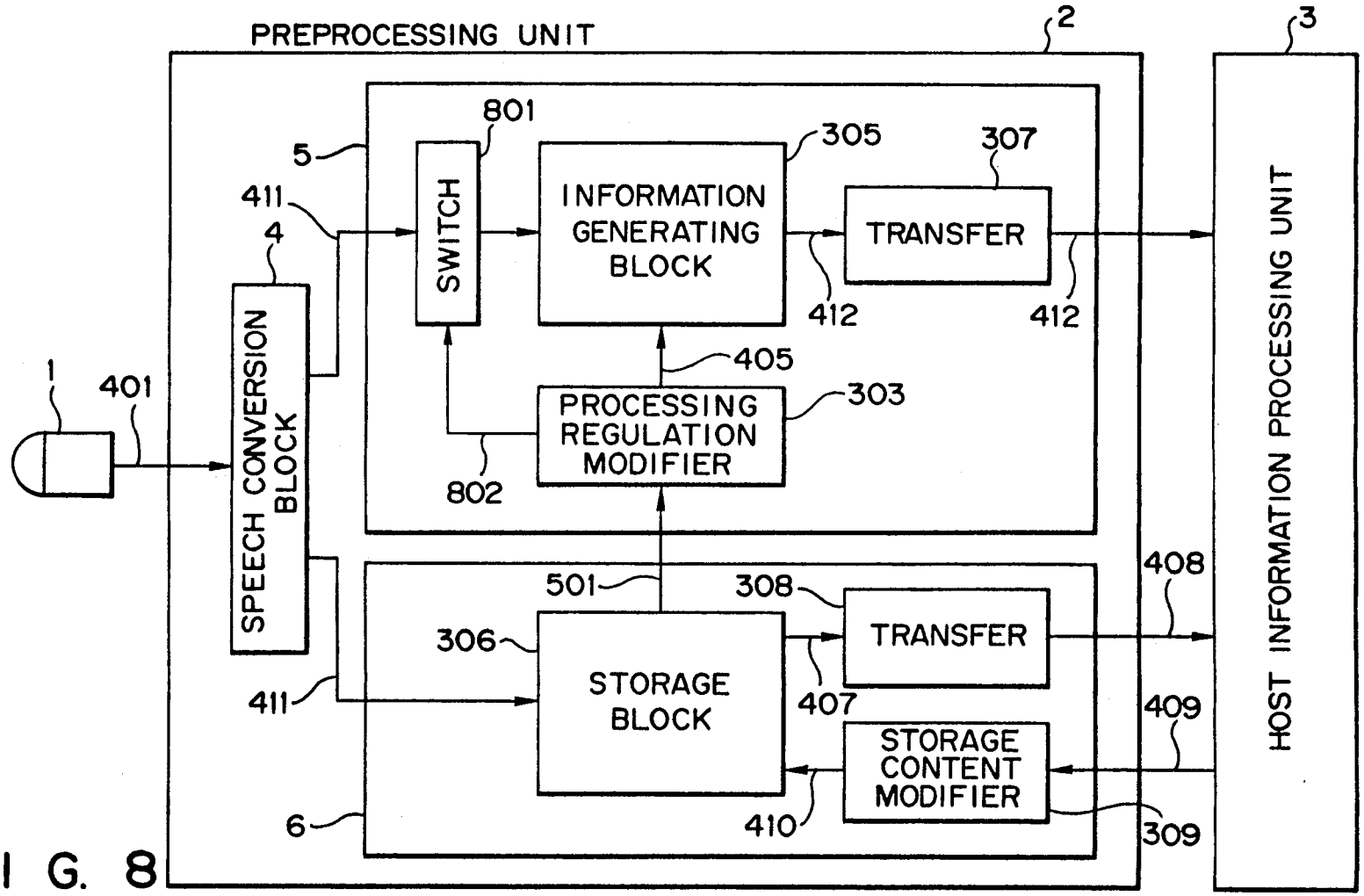
FIG. 8 is an explanatory view of another example of the preprocessing unit.

An application example of the system in the embodiment shown in FIG. 1 is described below with reference to FIG. 8. This application example is configured by adding a switch 801 to the system shown in FIG. 1 so that an information generating section 5 is operated only when the speech of a particular talker is recognized by a storage section 6, and the speech of the particular talker alone is extracted and then sent to the information processing unit 3.

As in the system shown in FIG. 1, a plurality of the processor elements 403 of the storage block 306 comprise one processor element which is activated to the pitch frequency of a particular talker by the modifier 309. When the pitch frequency of the particular talker is detected by the modifier 303, the modifier 303 outputs a signal 802 to the switch 801 so as to close it. In other words, when the switch 801 is opened, the storage block 305 does not operate. In this way, when the switch 801 is turned on, the extraction of only a portion in the aural signals 411 which is also significant from the viewpoint of time by the information generating section 5 enables rapid processing in the host unit 3.

A talker recognition/selector circuit 606 recognizes the talkers by collating the formants extracted by the circuit 600 with the data stored in the dictionary 605. 607 is a r-bit buffer to store the result of talker collation detected by the transferrer 308. Each bit represents whether or not the corresponding comparator of the transferrer 308 has detected that the corresponding processor element of the storage block 306 has been entrained. The circuit 606 compares the result stored in the buffer 607 with the result of talker recognition based on the formant matching operation. Thereby, the talker recognition in the storage block 306 can be confirmed within the processing unit 3.

A r-bit buffer 608 is used to temporarily store the information 409*a* to 409*c*.

Effect of Embodiment

The above-described systems of the embodiments have the following effects:

(1): The use of the storage block 306 comprising processor elements each comprising nonlinear oscillators and the modifier 309 enables recognition at high speed that the input aural signals 401 (or 411) containing the speech of a plurality of talkers contain the aural signals of particular talkers. That is, it is possible to recognize the talkers of conversation. Such acceleration of recognition is achieved by using the processor elements each comprising nonlinear oscillators.

(2): Only a significant portion is then extracted from the input aural signals 401 (or 411) on the basis of the recognition of the item (1). In other words, the use of the information generating block 305 comprising processor elements each comprising nonlinear oscillator circuits and the modifier 303 enables extraction at high speed of the speech of the particular talker. Such acceleration of extraction is achieved by using the processor elements each comprising nonlinear oscillator circuits.

(3): The information of a total volume reduced by extracting the speech 412 of only the particular talker from the input aural signals 401 (or 411) in the extraction of the item (2) is then sent to the host information processing unit 3 through the transferrer 307. In this host information processing unit 3, it is therefore possible to perform processing of the speech of a particular talker with a good precision, for example, recognition processing of words and so on in the input aural signals or talker collation processing for determining by collation as to whether or not the talker signal extracted by the preprocessing unit 2 is the aural signal of a particular desired talker.

(4): The talker whose speech is extracted can be freely specified by the storage content modifier 309 through the signal lines 409*a*, 409*b*, 409*c* from the host information processing unit 3. In other words, it is also possible to freely change the pitch frequency of a talker whose speech is desired to be extracted, as well as determining whether or not extraction is conducted from the host information processing unit 3.

Alternative

Various types of alternatives of the present invention are possible within the scope of the gist of the present invention.

Each of the above described embodiments utilizes as the circuit form of an oscillator unit a van der Pol circuit which has stable characteristics of the basic oscillation. This is because such a van der Pol circuit has a high level of reliability with respect to the stability of the waveform. However, an oscillator unit may be realized by using a method using another form of nonlinear circuit, a method using a digital circuit which is capable of calculating nonlinear oscillation or any optical means, mechanical means or chemical means which is capable of generating nonlinear oscillation. In other words, optical elements or chemical elements utilizing potential oscillation of a film as well as electrical circuit elements may be used as nonlinear oscillators.

In addition, although the system shown in FIG. 4 is designed with the aim at extracting the speech of one particular talker, the present invention enables simultaneous extraction of the speech of a plurality of particular talkers. In this case, it is necessary to set regulation modifiers 303 and information generating blocks 305 in a number equivalent to the number of the talkers.

Furthermore, in the system shown in FIG. 1, although the talker recognition is performed by detecting the average pitch frequency of speech in the storage block, it is possible to change this in such a manner that a talker is recognized by detecting the formant frequency.

Furthermore, although the circuit 606 in FIG. 7 is provided to confirm the collation result obtained by the storage block 306, it is possible to rearrange the circuit 606 in such a manner that the data stored in the buffer 607 may be used to narrow the scope of the search effected by the circuit 606. Thereby, the efficiency of talker confirmation effected by the circuit 606 is improved.

Although the present invention may be modified or changed in various manners, the range of the present invention should be interpreted within the range of the appended claims.

What is claimed is:

1. A speech processing apparatus comprising:

conversion means for inputting the speech of a plurality of talkers and outputting a speech signal representing the speech of the plurality of talkers;

detection means, comprising at least one first processor element, for detecting a first frequency that characterizes the aural signal of a talker to be specified from said speech signal, said first processor element comprising a circuit having a plurality of nonlinear oscillators which are so set so as to entrained at the first frequency; and extraction means, connected to said conversion means and detection means, for extracting the aural signal of the specified talker from said speech signal when detection means detects said first frequency in said speech signal.

2. A speech processing apparatus according to claim 1, wherein said plurality of nonlinear oscillators is a van der Pol oscillator circuit.

3. A speech processing apparatus according to claim 1, wherein said first frequency characterizing the aural signal of the specified talker is the average pitch frequency contained in the aural signal of the specified talker.

4. A speech processing apparatus according to claim 1, wherein said first processor element comprises two nonlinear oscillators and an oscillation control circuit for setting the basic frequencies in the oscillators, respectively, the difference between the basic frequencies for two nonlinear oscillators and the average frequency thereof respectively corresponding to the band width and the central frequency within a range where said entrainment takes place.

5. A speech processing apparatus according to claim 1, wherein said extraction means comprises a plurality of second processor elements for extracting the aural signal for the specified talker from said aural signals input therein, each of said second processor elements comprising a plurality of nonlinear oscillators which are so set as to be entrained at a frequency which is an integral multiple of said first frequency.

6. A speech processing apparatus according to claim 5, wherein each of said second processor elements comprises two nonlinear oscillators and an oscillation control circuit for setting the basic frequencies in the oscillators, the difference between said basic frequencies of said two nonlinear oscillators and the average frequency thereof respectively corresponding to the band width and the central frequency in a range where said entrainment takes place.

7. A speech processing apparatus according to claim 1, further comprising modification means for modifying each of said first frequencies which is so set that said at least one first processor element is entrained.

8. A speech processing apparatus according to claim 1 further comprising means for inhibiting any entrainment of at least said one first processor element.

9. A speech processing apparatus for specifying a plurality of specified talkers from the speech thereof, comprising:

conversion means for inputting the speech of the plurality of specified talkers and outputting a speech signal thereof; and detection means, connected to said conversion means and comprising a plurality of first processor elements, for detecting first frequencies each of which characterizes the aural signal of a talker to be specified from the speech signal, each of said first processor elements comprising a circuit having a plurality of nonlinear oscillators which are so set so as to entrained at the first frequency.

10. A speech procesing apparatus according to claim 9, wherein said plurality of nonlinear oscillators are a van der Pol oscillator circuits.

11. A speech processing apparatus according to claim 9, wherein each of said first frequencies characterizing said speech of a specified talker is the average pitch frequency of the specified talker.

12. A speech processing apparatus according to claim 9, wherein each of said first processor elements comprises two nonlinear oscillators and an oscillator control circuit for setting the basic frequencies of the oscillators, the difference between said basic two frequencies of said two nonlinear oscillators and the average value thereof respectively corresponding to the band width and the central frequency within the range where said entrainment takes place.

13. A speech processing system comprising:

conversion means for inputting speech of a plurality of talkers and outputting the aural signals thereof;

detection means, comprising at least one first processor element for detecting a first frequency that characterizes the aural signals of a talker to be specified from said aural signals of the plurality of talkers, said first processor element comprising a circuit having a plurality of nonlinear oscillators which are so set as to be entrained at the first frequency;

extraction means, connected to said conversion means and said detection means, for extracting the aural signal of the talker to be specified from the aural signals of the plurality of talkers when said detection means detects the first frequency in said aural signal of the plurality of talkers; and information processing means connected to said extraction means for performing information processing on said aural signal of said particular extracted by said extraction means.

14. A speech processing system according to claim 13, wherein said information processing means comprises modification means for modifying said first frequency which is so set that said at least one first processor element is entrained.

15. A speech processing system according to claim 13, wherein said information processing means further comprises means for inhibiting any entrainment of at least said one first processor element.

16. A speech processing apparatus comprising:

conversion means for inputting speech information;

supply means for supplying recognition information for recognizing a talker;

processing means, having a processing unit comprising a first input unit, a second input unit and a nonlinear oscillator, for processing said speech information input from said conversion means therein through said first input unit by changing the processing form of said input speech information on the basis of said recognition information input from said second input unit, and for outputting the processed speech information; and means for applying to said second input unit said recognition information supplied from said supply means for processing said speech information in said processing means, said speech information being input from said conversion means through said first input unit and being processed using said recognition information input from said second input unit.

17. A speech processing apparatus for specifying a plurality of specified talkers from the speech thereof, comprising:

conversion means for inputting the speech of the plurality of talkers and outputting a speech signal thereof;

detection means, connected to said conversion means, comprising a plurality of sets of first processor elements for detecting first frequencies each of which characterizes the aural signal of a talker to be specified from the speech signal, each of said first processor elements comprising a circuit having a plurality of nonlinear oscillators each of which are so set as to be entrained at the first frequency, where the number of the sets of said first processor elements equals the number of talkers to be specified;

extraction means for extracting the aural signal of a specified talker from said speech signal, said extraction means including a plurality of second processor elements, each of which comprises a circuit having a plurality of nonlinear oscillators which are so set as to be entrained at a frequency which is an integral multiple of a second frequency; and modification means, connected to said detection means and said extraction means, for changing the values of the second frequency to the first frequency at which said first processor elements of said detection means are entrained.

18. A speech processing apparatus comprising:

conversion means for inputting the speech of a plurality of talkers and outputting a speech signal representing the speech of the plurality of talkers;

detection means, comprising at least one first processor element, for detecting a first frequency that characterizes the aural signal of a talker to be specified from said speech signal, said first processor element comprising a unit having a plurality of nonlinear oscillators which are so set as to be entrained at the first frequency.

19. A speech processing apparatus according to claim 18, further comprising extraction means, connected to said conversion means and detection means, for extracting the aural signal of the specified talker from said speech signal when detection means detects said first frequency in said speech signal.

20. A speech processing apparatus according to claim 18, wherein said plurality of nonlinear oscillators comprise a van der Pol oscillator.

21. A speech processing apparatus according to claim 18, wherein said first frequency characterizing the aural signal of the specified talker is the average pitch frequency contained in the aural signal of the specified talker.

22. A speech processing apparatus according to claim 18, wherein said first processor element comprises two nonlinear oscillators and oscillation control means for setting the basic frequencies in the oscillators, respectively, the difference between the basic frequencies for two nonlinear oscillators and the average frequency thereof respectively corresponding to the band width and the central frequency within a range where said entrainment takes place.

23. A speech processing apparatus according to claim 19, wherein said extraction means comprises a plurality of second processor elements for extracting the aural signal for the specified talker from said aural signals input therein, each of said second processor elements comprising a plurality of nonlinear oscillators which are so set as to be entrained at a frequency which is an integral multiple of said first frequency.

24. A speech processing apparatus according to claim 23, wherein each of said second processor elements comprises two nonlinear oscillators and oscillation control means for setting the basic frequencies in the oscillators, the difference between said basic frequencies of said two nonlinear oscillators and the average frequency thereof respectively corresponding to the band width and the central frequency in a range where said entrainment takes place.

25. A speech processing apparatus according to claim 18, further comprising modification means for modifying each of said first frequencies which is so set that said at least one first processor element is entrained.

26. A speech processing apparatus according to claim 18 further comprising means for inhibiting any entrainment of said at least one first processor element.

27. A speech processing system comprising:

conversion means for inputting speech of a plurality of talkers and outputting the aural signals thereof;

detection means, comprising at least one first processor element for detecting a first frequency that characterizes the aural signals of a talker to be specified from said aural signals of the plurality of talkers, said first processor element comprising a unit having a plurality of nonlinear oscillators which are so set as to be entrained at the first frequency;

extraction means, connected to said conversion means and said detection means, for extracting the aural signal of the talker to be specified from the aural signals of the plurality of talkers when said detection means detects the first frequency in said aural signal of the plurality of talkers; and information processing means connected to said extraction means for performing information processing on said aural signal of said particular talker extracted by said extraction means.

28. A speech processing system according to claim 27, wherein said information processing means comprises modification means for modifying said first frequency which is so set that said at least one first processor element is entrained.

29. A speech processing system according to claim 27, wherein said information processing means further comprises means for inhibiting any entrainment of said at least one first processor element.

30. A speech processing apparatus for specifying a plurality of specified talkers from the speech thereof, comprising:

conversion means for inputting the speech of the plurality of talkers and outputting a speech signal thereof;

detection means, connected to said conversion means, comprising a plurality of sets of first processor elements for detecting first frequencies each of which characterizes the aural signal of a talker to be specified from the speech signal, each of said first processor elements comprising a unit having a plurality of nonlinear oscillators each of which are so set as to be entrained at the first frequency, where the number of the sets of said first processor elements equals the number of talkers to be specified;

extraction means for extracting the aural signal of a specified talker from said speech signal, said extraction means including a plurality of second processor elements, each of which comprises a unit having a plurality of nonlinear oscillators which are so set as to be entrained at a frequency which is an integral multiple of a second frequency; and modification means, connected to said detection means and said extraction means, for changing the values of the second frequency to the first frequency at which said first processor elements of said detection means are entrained.

31. A speech processing apparatus comprising:

conversion means for inputting the speech of a plurality of talkers and outputting a speech signal representing the speech of the plurality of talkers; and detection means comprising at least one first processor element, for detecting a first frequency that characterizes the aural signal of a talker to be specified, from said speech signal, said first processor element having generators for generating signals which are entrained at the first frequency.

32. A speech processing apparatus according to claim 31, further comprising:

extraction means, connected to said conversion means and detection means, for extracting the aural signal of the specified talker from said speech signal when detection means detects said first frequency in said speech signal.

* * * * *

UNITED STATES PATENT AND TRADEMARK OFFICE

CERTIFICATE OF CORRECTION

PATENT NO. : 5,123,048

DATED : June 16, 1992

INVENTOR(S) : KOICHI MIYAMAE, ET AL.

It is certified that error appears in the above-identified patent and that said Letters Patent is hereby corrected as shown below: Title Page:

[56] FOREIGN PATENT DOCUMENTS

Line 2, "2633656 2/1987 Fed. Rep. of Germany" should read --2633656 2/1978 Fed. Rep. of Germany--.

[56] OTHER PUBLICATIONS

Line 13, "Oshuga et al.," should read --Ohsuga et al.,--.

SHEET 9 OF THE DRAWINGS

Figure 9:
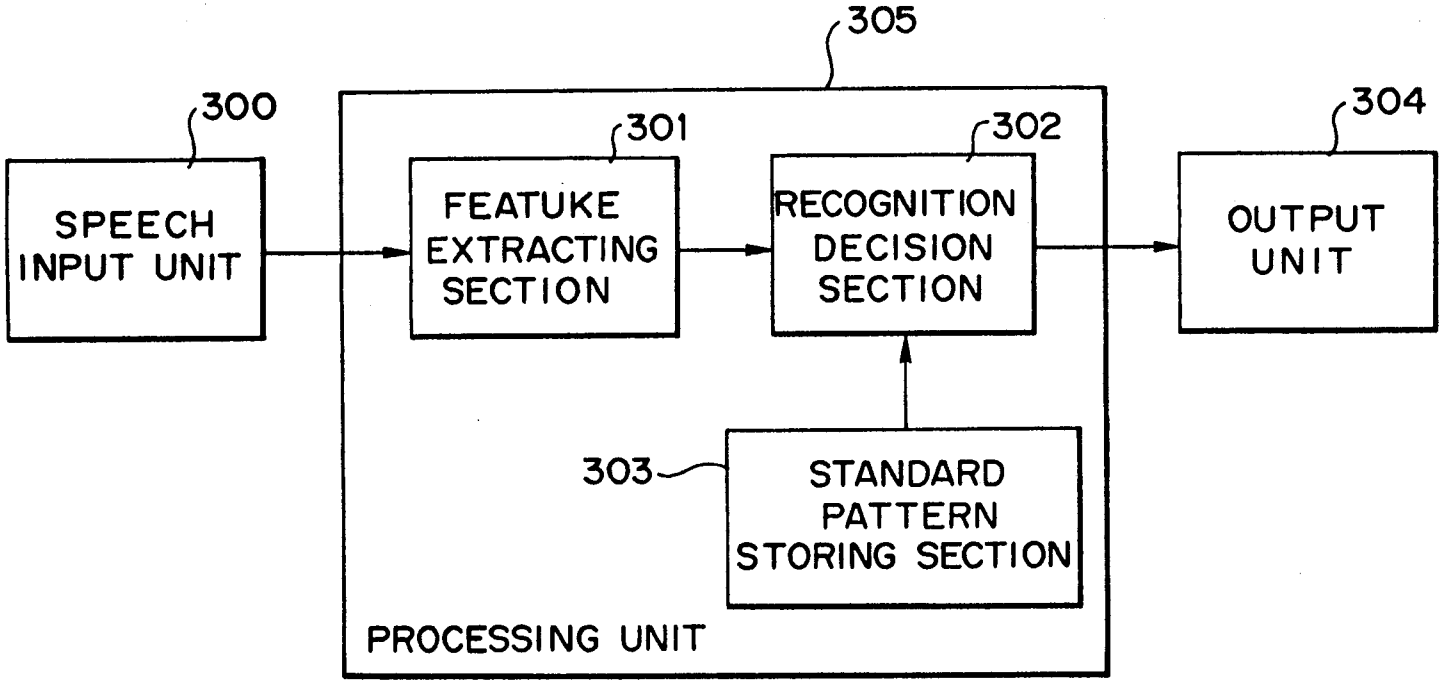
FIG. 9 (PRIOR ART)
FIG. 9 is an explanatory view of the configuration of an example of conventional speech processing apparatuses.

Figure 9, "FEATUKE" should read --FEATURE--

COLUMN 3

Line 15, "non linear" should read --non-linear--.

COLUMN 4

Line 63, "a" should be deleted.

COLUMN 5

Line 15, "non linear" should read --non-linear--.

Line 25, "non linear" should read --non-linear--.

COLUMN 6

Line 3, "variable resistors 20.21" should read --variable resistors 20,21--.

UNITED STATES PATENT AND TRADEMARK OFFICE

CERTIFICATE OF CORRECTION

DATED : June 16, 1992

INVENTOR(S) : KOICHI MIYAMAE, ET AL.

It is certified that error appears in the above-identified patent and that said Letters Patent is hereby corrected as shown below:

COLUMN 7

Line 49, "An" should read --A--.

COLUMN 8

Line 1, "an" should read --and--.

Line 45, "functions" should read --function--.

COLUMN 10

Line 46, "line" should read --lines--.

COLUMN 13

Line 31, "at" should read --of--.

Line 65, "so as to en-" should read --as to be en- --.

UNITED STATES PATENT AND TRADEMARK OFFICE

CERTIFICATE OF CORRECTION

DATED : June 16, 1992

INVENTOR(S) : KOICHI MIYAMAE, ET AL.

It is certified that error appears in the above-identified patent and that said Letters Patent is hereby corrected as shown below:

COLUMN 14

Line 5, "is a" should read --are--.

Line 6, "oscillator circuit." should read --oscillators.--

Line 43, "1" should read --1,--.

Line 44, "at least said" should read --said at least--.

Line 60, "a" should be deleted.

UNITED STATES PATENT AND TRADEMARK OFFICE

CERTIFICATE OF CORRECTION

PATENT NO. : 5,123,048 Page 4 of 4

DATED : June 16, 1992

INVENTOR(S) : KOICHI MIYAMAE, ET AL.

It is certified that error appears in the above-identified patent and that said Letters Patent is hereby corrected as shown below:

COLUMN 15

Line 26, "particular extracted" should read --particular talker extracted--.

Line 35, "at" should be deleted.

Line 36, "least said" should read --said at least--.

COLUMN 17

Line 8, "18" should read --18,--.

the --.

Signed and Sealed this

Seventh Day of September, 1993

Bruce Lehman

*Attest:*

BRUCE LEHMAN

*Attesting Officer*

*Commissioner of Patents and Trademarks*